US005810257A

United States Patent [19]

Ton

[11] Patent Number: 5,810,257

[45] Date of Patent: Sep. 22, 1998

[54] ROTARY SPA JET

[75] Inventor: Thai T. Ton, Lemon Grove, Calif.

[73] Assignee: Watkins Manufacturing Corporation, Vista, Calif.

[21] Appl. No.: 747,444

[22] Filed: Nov. 12, 1996

[51] Int. Cl.[6] ..... B05B 3/06

[52] U.S. Cl. ..... 239/259; 233/261; 233/264; 601/169; 4/541.6

[58] Field of Search ..... 239/226, 246, 239/251, 259, 261, 264, 428.5; 601/169; 4/541.6, 541.4

[56] References Cited

U.S. PATENT DOCUMENTS

| | | | |
|---|---|---|---|
| 3,868,949 | 3/1975 | Arneson | 128/66 |
| 4,349,923 | 9/1982 | Chalberg | 4/542 |
| 4,508,665 | 4/1985 | Spinnett | 261/93 |
| 4,542,853 | 9/1985 | Diamond | 239/428.5 X |
| 4,982,459 | 1/1991 | Henkin et al. | 4/541 |
| 5,014,372 | 5/1991 | Thrasher et al. | 4/542 |
| 5,226,601 | 7/1993 | Hinojosa, Jr. et al. | 239/428.5 |
| 5,271,561 | 12/1993 | Tobias et al. | 239/289 |
| 5,291,621 | 3/1994 | Mathis | 4/541.4 |

*Primary Examiner*—Lesley D. Morris
*Attorney, Agent, or Firm*—Price, Gess & Ubell

[57] ABSTRACT

A rotating nozzle for use in whirlpools, spas, baths, pools and the like is disclosed wherein a nozzle comprising a rotating head and integral cylindrical pipe-shaped inlet is mounted directly within a mounting bracket using a ball bearing assembly. Inner and outer ball bearing races on the nozzle inlet and mounting bracket respectively journal the nozzle in the mounting bracket, and the outlets of the nozzle are aligned to dispel water in a manner to impart rotation on the nozzle. The inner and outer races house a set of ball bearings, and a spacer which maintains adequate separation of the ball bearings. The unitary design of the present invention is simpler than the prior art and requires fewer parts, and the reduction in frictional losses translates into a faster rotation and increased massage effect.

18 Claims, 3 Drawing Sheets

ROTARY SPA JET

BACKGROUND OF THE INVENTION

1. Field of the Invention

The present invention relates to nozzles generally, and, specifically, to a rotating nozzle and mounting bracket adapted for use in spas, whirlpools, and similar therapeutic receptacles which rotate while dispensing pressurized fluid to produce a hydromassage effect.

2. Description of Related Art

It is well known that a jet of warm or hot water, when directed to a person's limbs and torso, has a pleasing massage effect. The heated water promotes tissue regeneration by increasing the flow of blood to the area and also soothes muscles sore from stress or exertion. Hydromassage has become a common method of treating stress and soreness due to the relaxing nature of the effect. Spas, whirlpools, therapeutic baths, and the like are designed to take advantage of this feature by directing a forced stream of heated water in a tub such that the stream impinges on the occupant. Typically, jets will be mounted in or along the side of a reservoir where the occupant can relax with the jet streams positioned at various locations requiring the treatment.

In the prior art, each jet is typically connected to a supply of pressurized heated water which can be expelled through the jet, and usually includes a mixture of heated water and air. The inclusion of air into the heated water stream has been found to increase the massage effect due to the turbulence which is created. This relaxing effect can be enhanced by altering the delivery of the heated water to produce a pulsating effect, and this enhanced effect can be achieved by either intermittently interrupting the supply of water to the nozzle or having the jets rotate in a circular pattern. The prior art is replete with nozzles which spin as water or water and air are dispelled from exit jets, such as that of Tobias et al., U.S. Pat. No. 5,271,561 and Arneson, U.S. Pat. No. 3,868,949.

Arneson U.S. Pat. No. 3,868,949 discloses a hydromassage device comprising a rotating disc with an inlet and two outlets which have a canceling radial force and a positive resultant torqueing force. The device has a rotor-like head which swivels about an inlet tube using a ball bearing assembly, and includes a housing for the assembly and two flanged tubes separated by a washer and O-ring seal. No inner or outer race is disclosed for positioning the ball bearings and the assembly includes screws, washers, O-rings, flanges, and two separate tubes. The device is designed to attach to a flexible hose so that a stream of water can be manually directed to the desired area.

Tobias U.S. Pat. No. 5,271,561 discloses a rotary jet hydrotherapy device including an embodiment shown in FIG. 1 illustrating a rotating jet nozzle. The Tobias nozzle comprises an inner track rotating on ball bearings inside the rear connecting element with the nozzle inlet loosely rotating within the inner track. The dual level of rotation results in unnecessary frictional losses which affect performance of the nozzle. The fact that the Tobias nozzle comprises two separable elements (the nozzle and the rear connecting element) requires some "play" in the tolerances of the connecting parts so that they can be connected and disconnected, which leads to further misalignment of the parts and additional friction. Furthermore, there is a relatively large bearing surface between the nozzle and the inner track which contributes to the frictional losses. Finally, the nozzle is supported at its end and the weight of the nozzle head can cause the nozzle inlet to rub against the inner track resulting in even further frictional losses.

OBJECTS AND SUMMARY OF THE INVENTION

It is an object of the invention to improve fluid discharge nozzles and, particularly, rotary discharge nozzles employed in various therapeutic and recreational environments;

It is another object of the present invention to provide a nozzle and mounting assembly which captures a flow of water more efficiently than the prior art;

It is another object of the present invention to simplify the design of a hydrotherapeutic spa nozzle;

It is another object of the present invention to provide a nozzle with a reduced bearing area as compared with the prior art; and It is yet another object of the present invention to provide a mounting assembly for a spa nozzle which balances the nozzle closer its center of mass.

In accordance with the present invention, a unitary rotating nozzle for use in spas, and other therapeutic is provided. The nozzle has offset exit jets which are directed to impart a rotation on the nozzle. The nozzle includes an inlet which is integral with the nozzle head and extends through a mounting bracket. Both the nozzle inlet and the mounting bracket have races which, along with a set of ball bearings, cooperate to provide rotation. The mounting bracket is preferably press-fit onto the bearing assembly and the nozzle is journaled therein, such that the entire nozzle and mounting bracket assembly comprise a unitary rotating nozzle.

The present invention provides a number of improvements and advantages over the prior art. The mounting bracket includes pegs which attach and position the mounting bracket. The nozzle is journaled in the mounting bracket and can rotate freely therein. Water is entrained into the nozzle inlet, which is positioned in the flow, and the water exits the nozzle through outlets at the end of the nozzle. The nozzle outlets are directed to impart a rotation on the nozzle which causes the nozzle to spin and produce the desired pulsating effect. In a preferred embodiment the ball bearing sits in a race on the nozzle inlet and a race on the mounting bracket to eliminate the need for an inner sleeve.

BRIEF DESCRIPTION OF THE DRAWINGS

The objects and features of the present invention, which are believed to be novel, are set forth with particularity in the appended claims. The present invention, both as to its organization and manner of operation, together with further objects and advantages, may best be understood by reference to the following description, taken in connection with the accompanying drawings, of which:

DETAILED DESCRIPTION OF THE PREFERRED EMBODIMENTS

Figure 1:
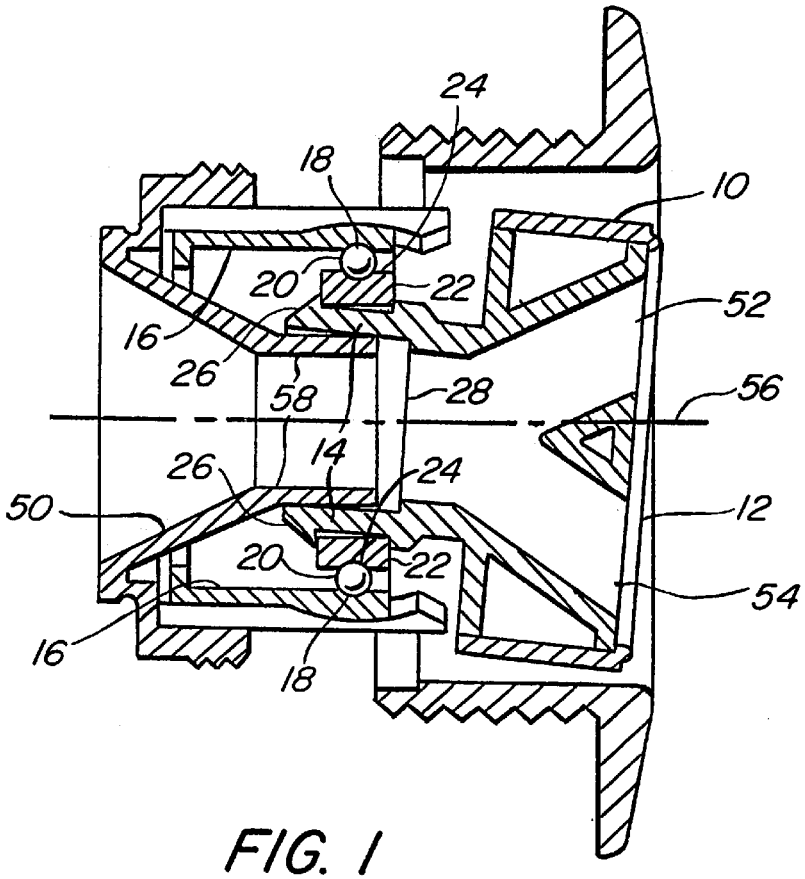
FIG. 1 PRIOR ART
FIG. 1 is a cross-sectional view of a prior art nozzle.
Figure 2:
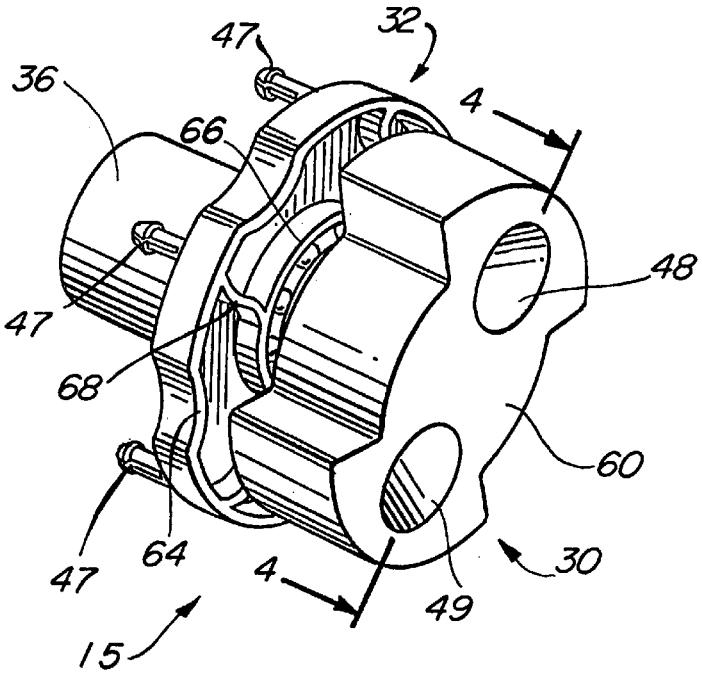
FIG. 2 is a perspective view of the preferred embodiment of the invention.

The following description is provided to enable any person skilled in the art to make and use the invention and sets forth the best modes contemplated by the inventor of carrying out his invention. Various modifications, however, will remain readily apparent to those skilled in the art, since the generic principles of the present invention have been defined herein specifically to hydrotherapeutic rotating nozzles.

A preferred embodiment of a rotating nozzle assembly 15 is shown in greater detail in FIGS. 2–7. It is preferably molded from a thermoplastic material and comprises a cylindrical pipe section 36, a nozzle 30, and a male retainer or bracket 32. The pipe section 36 forms the inlet 37 of the nozzle 30. The nozzle head 60 has two diverging channels 62, 63 which terminate in respective outlets 48, 49.

Figure 3:
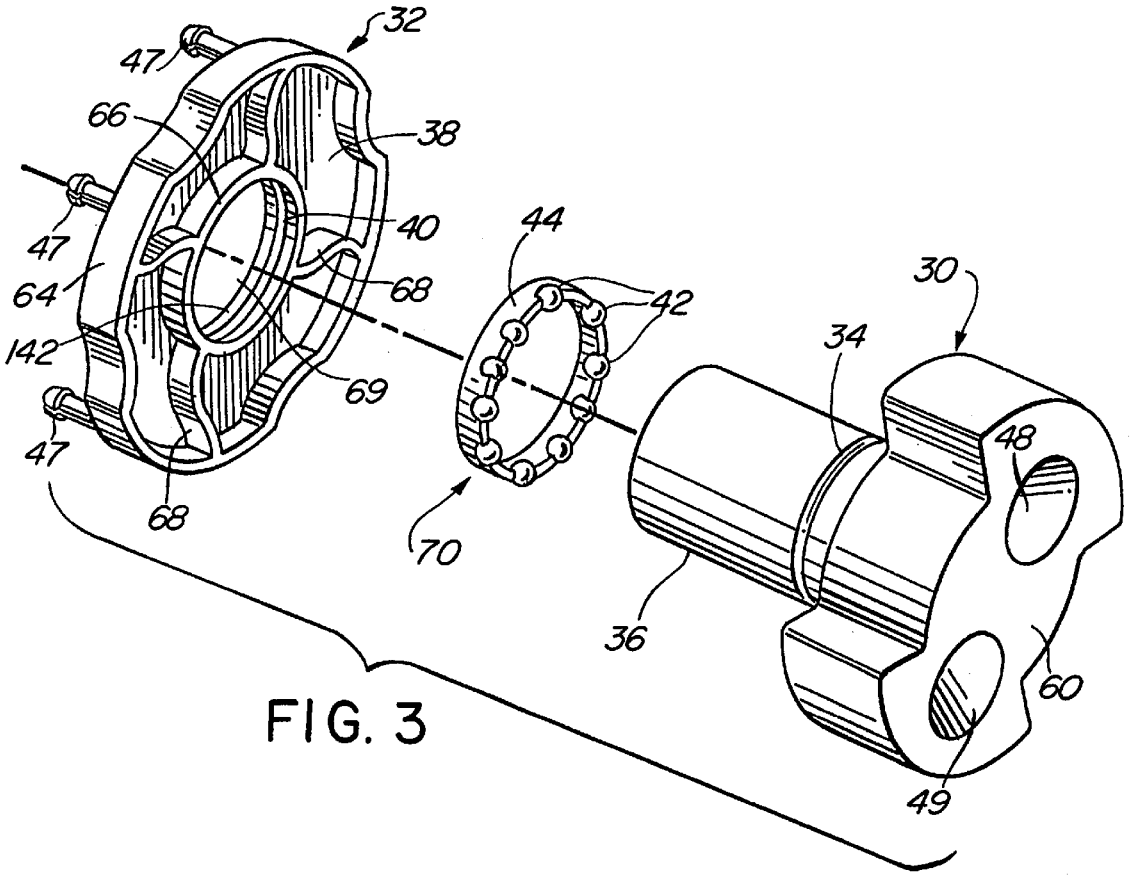
FIG. 3 is an exploded view of the preferred embodiment of the invention.

As shown in FIG. 3, the pipe section 36 has a circumferential recess or undercut 34 formed therein wherein reside bearings 42 of a bearing assembly 70. This assembly 70 further includes a cage 44 which includes circumferential recesses along one edge of the cage 42, which recesses capture and securely hold a respective one of the bearings 42.

The male retainer 32 has a plate 38 with a scalloped outer rim 64 and a raised circular inner rim 66. These rims 64, 66 are connected by raised undulating spokes 68, which give the male retainer 32 stiffness. The circular inner rim 66 defines a central opening or hole 69, which receives the pipe section 36. The inner surface 142 of the inner rim 66 includes a continuous recess or undercut defining an outer bearing race 40. The male retainer 32 could be of various other shapes. For example, its outer rim could be circular instead of scalloped and instead of having spokes, the retainer 32 could be of a constant thickness.

The inner race 34 and the outer race 40 provide the raceway for the ball bearings 42. The assembly formed by the bearings 42 and their attached cage 44 is preferably installed by snap-fitting the bearings 42 into the races or undercuts 34, 40. The cage 44 further assists in retaining the bearings 42 within the race, as does a raised outer lip 143 located on the inner rim 142, which further ensures that the bearings 42 will not escape.

Figure 4:
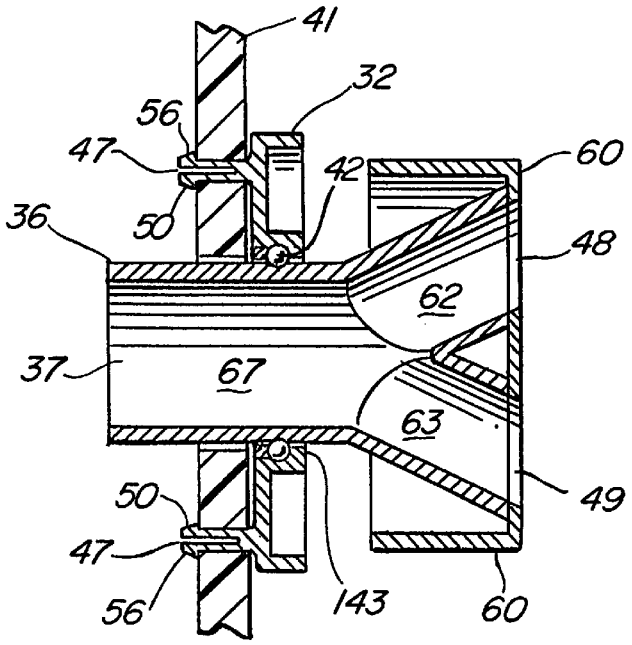
FIG. 4 is a cross-sectional view of the preferred embodiment of the invention.

FIG. 4 illustrates that the only bearing surface of the pipe section 36 is the integrally-formed race 34. FIG. 4 further illustrates that the nozzle 30 is approximately balanced at its point of support by the inner race 34, with the nozzle head 60 on one side and the majority of the nozzle inlet 37 on the opposite side. Such balancing reduces bending moments which result from the cantilevering of the nozzle 30, which discourages undesirable rubbing of the nozzle inlet 37 against the female retainer or other parts.

FIG. 4 further illustrates the preferred method of connecting the mounting bracket 32 to a female retainer 41. The mounting bracket 32 includes a plurality of pegs 47, which protrude perpendicularly to the plate 38 and are directed opposite to the direction of the nozzle head 60. Each peg 47 comprises two resiliently spaced apart fingers 56, which can be press-fittingly inserted into suitable apertures in the female retainer 41 and which release upon execution of a manually applied pulling force to permit extraction of the rotary nozzle 15 from the structure.

Figure 5:
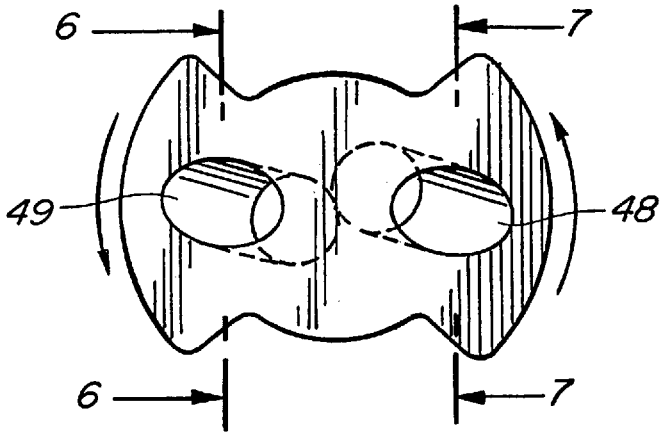
FIG. 5 is a front view of the nozzle outlet.
Figure 6:
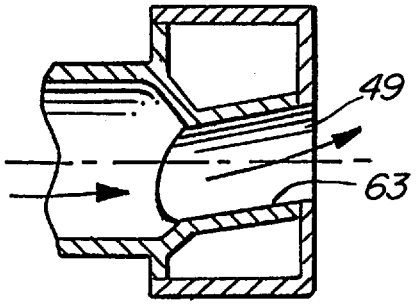
FIG. 6 is a cut-away view of a first outlet jet.
Figure 7:
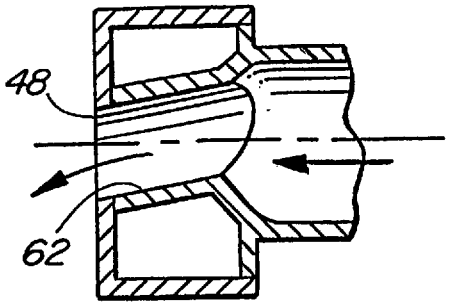
FIG. 7 is a cut-away view of a second outlet jet.

FIG. 5 depicts the face of the nozzle head 60 and illustrates the skewed direction of the outlets 48, 49. When the nozzle head 60 is in the position shown, channel 62 is directed downward and outward, and channel 63 is directed upward and outward. As water passes from each channel's inlet, the radial forces on the walls of the channels 62, 63 cancel, while a downward force is exerted on channel 63 and an upwards force is exerted on channel 62. The resultant of these two forces causes rotation of the nozzle head 60 in the direction shown, as known in the art. FIGS. 6 and 7 further illustrate the outlets 48, 49 and the water's change of direction, which results in the rotational force on the nozzle.

It will be understood that the embodiments described herein are merely exemplary and that a person skilled in the art may make many variations and modifications without departing from the spirit and scope of the invention. All such variations and modifications are intended to be included within the scope of the invention as defined in the appended claims.

What is claimed is:

1. A rotating nozzle for use in a hydrotherapeutic reservoir comprising:

a cylindrical pipe having an outer circumferential recess defining an inner race, said cylindrical pipe terminating in a discharge nozzle adapted to dispel fluid in a manner to impart a rotational moment on the nozzle about a centerline of the cylindrical pipe;

a mounting bracket adapted to rotationally mount said cylindrical pipe having a continuous inner edge defining a circular aperture sized to receive said circular pipe therein at said outer circumferential recess, and said inner edge recessed to define an outer race; and a plurality of ball bearings operationally disposed between said inner race and said outer race and in contact therewith for journalling the cylindrical pipe within the mounting bracket.

2. A rotating nozzle as recited in claim 1 wherein an end of said cylindrical pipe opposite said end terminating in the discharge nozzle extends through said mounting bracket.

3. A rotating nozzle as recited in claim 2 wherein said cylindrical pipe and said mounting bracket are comprised of a thermoplastic material.

4. A rotating nozzle as recited race in claim 3 further comprising annular spacer means seated between said inner and said outer race for maintaining a generally constant circumferential spacing between said plurality of ball bearings.

5. A rotating nozzle as recited in claim 4 wherein said mounting bracket is press-fit onto said plurality of ball bearings at said inner edge.

6. A rotating nozzle as recited in claim 5 wherein said discharge nozzle is integral with said cylindrical pipe and comprises an inlet and at least two off-center spaced apart channels directed in a rotation imparting direction.

7. A rotating nozzle for dispensing water in a reservoir comprising:

a cylindrical pipe having a first end adapted to receive a flow of fluid therein;

a nozzle head fixedly mounted to a second end of the cylindrical pipe housing two spaced apart diverging channels each terminating at an outlet, said channels skewed with respect to a centerline of the cylindrical pipe to impart a rotational moment on the nozzle; and a mounting bracket comprising a plate and including means for journalling the cylindrical pipe in said mounting bracket and means to releasably secure said mounting bracket means to said reservoir.

8. The rotating nozzle as recited in claim 7 wherein said cylindrical pipe includes a continuous circumferential recess on an exterior surface and spaced from said first end to form an inner race, and where said mounting bracket means includes a continuous circular inner edge defining a circular aperture for receiving said cylindrical pipe therethrough, said continuous circular inner edge adapted to serve as an outer race, and wherein said means to rotationally mount said cylindrical pipe comprises a bearing having a plurality of ball bearings operationally disposed between said inner and outer race.

9. The rotating nozzle as recited in claim 8 wherein said mounting bracket means is sized to press-fit over said bearing to form a unitary nozzle.

10. The rotating nozzle as recited in claim 9 wherein said means to secure said mounting bracket to said reservoir comprises a plurality of pairs of spaced apart resilient fingers disposed on a surface of said mounting bracket and each pair including opposite extending lips which when said pair is inserted into a hole in said reservoir said lips are biased together and resiliently released apart upon passing through the hole to lock said mounting bracket to said reservoir.

11. The rotating nozzle as recited in claim 10 where said nozzle head and said cylindrical pipe are integrally molded as a unitary component.

12. The rotating nozzle as recited in claim 11 further including annular spacer means seated between said cylindrical pipe and said mounting bracket for maintaining separation between said ball bearings.

13. A rotating nozzle assembly for use in a hydrotherapeutic reservoir comprising:

a nozzle comprising an inlet and a nozzle head, said inlet comprising a cylindrical pipe having external circumferential recess means for defining an inner race, said cylindrical pipe terminating in said nozzle head having means to dispel fluid in a manner to impart a rotational moment on the nozzle about a centerline of the cylindrical pipe;

a mounting bracket having a continuous inner edge defining a circular aperture sized to receive said circular pipe therein at said outer circumferential recess, and said inner edge including internal circumferential recess means for defining an outer race; and ball bearing means operationally disposed between said inner race and said outer race and in contact therewith for journalling the cylindrical pipe within the mounting bracket.

14. A rotating nozzle as recited in claim 13 wherein said cylindrical pipe extends through said mounting bracket.

15. A rotating nozzle as recited in claim 14 wherein said cylindrical pipe and said mounting bracket are comprised of a thermoplastic material.

16. A rotating nozzle as recited race in claim 15 further comprising annular spacer means seated between said inner and said outer races for maintaining a generally constant circumferential spacing between said plurality of ball bearings.

17. A rotating nozzle as recited in claim 16 wherein said mounting bracket is press-fit onto said ball bearing means at said inner edge.

18. A rotating nozzle as recited in claim 17 wherein said nozzle head is integral with said cylindrical pipe and comprises a chamber and at least two off-center spaced apart channels directed in a rotation imparting direction.

* * * * *

UNITED STATES PATENT AND TRADEMARK OFFICE

CERTIFICATE OF CORRECTION

PATENT NO. : 5,810,257

DATED : September 22, 1998

INVENTOR(S) : Thai T. Ton

It is certified that error appears in the above-identified patent and that said Letters Patent is hereby corrected as shown below:

Claim 1, column 4, line 22, before "pipe", delete "circular" and substitute --cylindrical-- therefor.
Claim 7, column 4, line 60, after "bracket", delete "means".
Claim 9, column 5, line 6, after "bracket", delete "means".
Claim 9, column 5, line 7, delete "bearing" and substitute --ball bearings -- therefor-.
Claim 10, column 5, line 12, after "said" and before "pair", insert --each--.
Claim 13, column 5, line 28, after "nozzle head", insert --, said nozzle head--.
Claim 13, column, 5, line 29, after "means", insert --therein--.
Claim 13, column 6, line 2, change (2nd occurrence) "circular" to --cylindrical--.

Signed and Sealed this

First Day of June, 1999

*Attest:*

Q. TODD DICKINSON

*Attesting Officer*

*Acting Commissioner of Patents and Trademarks*